US009533422B2

(12) United States Patent
Perez-Lopez et al.

(10) Patent No.: US 9,533,422 B2
(45) Date of Patent: Jan. 3, 2017

(54) HAIR REMOVAL APPARATUS

(75) Inventors: Xavier Perez-Lopez, Eschborn (DE); Andreas Larscheid, Kelkheim (DE)

(73) Assignee: Braun GmbH, Kronberg (DE)

( * ) Notice: Subject to any disclaimer, the term of this patent is extended or adjusted under 35 U.S.C. 154(b) by 1470 days.

(21) Appl. No.: 12/522,284

(22) PCT Filed: Jan. 29, 2008

(86) PCT No.: PCT/EP2008/000651

§ 371 (c)(1),
(2), (4) Date: Jan. 6, 2010

(87) PCT Pub. No.: WO2008/092624

PCT Pub. Date: Aug. 7, 2008

(65) Prior Publication Data

US 2010/0139097 A1 Jun. 10, 2010

(30) Foreign Application Priority Data

Feb. 1, 2007 (DE) ..... 10 2007 005 853

(51) Int. Cl.
*B26B 19/06* (2006.01)
*B26B 19/20* (2006.01)
(Continued)

(52) U.S. Cl.
CPC ..... *B26B 19/06* (2013.01); *B26B 19/20* (2013.01); *B26B 19/382* (2013.01);
(Continued)

(58) Field of Classification Search
CPC ..... B26B 19/06; B26B 19/20; B26B 19/3813; B26B 19/3853; B26B 19/382; B26B 21/40; B26B 21/225; B26B 21/4081
(Continued)

(56) References Cited

U.S. PATENT DOCUMENTS 2,300,143 A * 10/1942 Berg ..... 30/34.1
3,690,000 A * 9/1972 Loner ..... 30/34.1
(Continued)

FOREIGN PATENT DOCUMENTS

DE 1907738 12/1964
DE 19531012 C1 10/1996
(Continued)

OTHER PUBLICATIONS

International search report dated Apr. 29, 2008, 1 page, case No. Z08051Q.
(Continued)

*Primary Examiner* — Jason Daniel Prone
(74) *Attorney, Agent, or Firm* — Ronald T. Sia; Kevin C. Johnson; Steven W. Miller

(57) ABSTRACT

A hair removal apparatus is described having a trimmer (4), whereby the trimmer (4) has at least two cutting parts (7, 8) each having rows of teeth drivable individually relative to one another, and having at least one wet shaver unit (21), which has at least one sharp-edged razor blade (22). The wet shaver unit (21) is arranged on a carrying element (19) that is guided movably on the housing (1). The carrying element is adjustable by the user in at least two different positions through a corresponding switching movement. The first position is a storage position of the wet shaver unit and the second position allows simultaneous removal of hair by the trimmer (4) which is leading in the direction of use (P) and the trailing wet shaver unit (21).

5 Claims, 7 Drawing Sheets

(51) Int. Cl.
*B26B 19/38* (2006.01)
*B26B 21/22* (2006.01)
*B26B 21/40* (2006.01)

(52) U.S. Cl.
CPC ..... *B26B 19/3813* (2013.01); *B26B 19/3853* (2013.01); *B26B 21/225* (2013.01); *B26B 21/40* (2013.01); *B26B 21/4081* (2013.01)

(58) Field of Classification Search
USPC ..... D28/46, 53; 30/34.05, 34.1, 43.9–43.92, 30/44, 45, 216
See application file for complete search history.

(56) References Cited

U.S. PATENT DOCUMENTS

| | | | | |
|---|---|---|---|---|
| 3,781,990 | A * | 1/1974 | Loner | 30/34.1 |
| 4,085,503 | A * | 4/1978 | Beck et al. | 30/34.1 |
| 4,262,415 | A * | 4/1981 | Braun | 30/34.1 |
| 4,285,124 | A * | 8/1981 | Diakonov | 30/34.1 |
| 4,393,585 | A * | 7/1983 | Nagelkerke | 30/34.1 |
| 4,461,078 | A | 7/1984 | Carreker | |
| 4,866,843 | A * | 9/1989 | Kumano | 30/34.1 |
| 4,930,217 | A * | 6/1990 | Wolf et al. | 30/34.1 |
| 5,054,199 | A * | 10/1991 | Ogawa et al. | 30/34.1 |
| 5,423,125 | A * | 6/1995 | Wetzel | 30/34.1 |
| 5,507,095 | A * | 4/1996 | Wetzel et al. | 30/34.1 |
| 6,052,905 | A * | 4/2000 | Branchinelli et al. | 30/34.1 |
| 6,314,648 | B1 * | 11/2001 | Hillebrandt | 30/34.1 |
| 6,481,103 | B2 * | 11/2002 | Van Hout et al. | 30/34.1 |
| D571,954 | S * | 6/2008 | Kling et al. | D28/46 |
| 7,503,117 | B2 * | 3/2009 | Wetzel et al. | 30/34.1 |
| 7,536,787 | B2 * | 5/2009 | Blaustein et al. | 30/34.05 |
| D604,908 | S * | 11/2009 | Kling | D28/53 |
| 7,761,998 | B2 * | 7/2010 | Blaustein et al. | 30/34.05 |
| 7,937,837 | B2 * | 5/2011 | Psimadas et al. | 30/34.1 |
| 2007/0006463 | A1 * | 1/2007 | Pennella | 30/34.1 |
| 2007/0180699 | A1 * | 8/2007 | Psimadas et al. | 30/34.1 |
| 2007/0283567 | A1 * | 12/2007 | Magli | 30/50 |
| 2008/0016691 | A1 * | 1/2008 | Pennella et al. | 30/34.1 |
| 2008/0301947 | A1 * | 12/2008 | Dorber et al. | 30/34.05 |
| 2009/0000125 | A1 * | 1/2009 | Peyser et al. | 30/34.1 |
| 2010/0299927 | A1 * | 12/2010 | Fischer et al. | 30/34.1 |
| 2011/0005082 | A1 * | 1/2011 | Fischer et al. | 30/45 |
| 2011/0010943 | A1 * | 1/2011 | Izumi | 30/34.1 |
| 2011/0126412 | A1 * | 6/2011 | Perez-Lopez et al. | 30/34.1 |
| 2011/0162207 | A1 * | 7/2011 | Maichel et al. | 30/34.1 |
| 2011/0167639 | A1 * | 7/2011 | Lau | 30/34.1 |

FOREIGN PATENT DOCUMENTS

| | | | |
|---|---|---|---|
| EP | 1410884 | A1 | 4/2004 |
| EP | 2145740 | A1 * | 1/2010 |
| JP | 54144256 | A * | 11/1979 |
| JP | 04322689 | A * | 11/1992 |
| JP | 11309281 | A | 11/1999 |
| WO | WO-00/37225 | A1 | 6/2000 |
| WO | WO-03041918 | | 5/2003 |
| WO | WO 2005102623 | A2 * | 11/2005 |
| WO | WO-2006007874 | A | 1/2006 |
| WO | WO 2008092623 | A1 * | 8/2008 |

OTHER PUBLICATIONS

International search report dated May 27, 2008, 2 pages, case No. Z08050Q.

* cited by examiner

HAIR REMOVAL APPARATUS

FIELD OF THE INVENTION

The present invention relates to a hair removal apparatus according to the preamble of patent claim 1, having a wet shaver and a trimmer.

BACKGROUND OF THE INVENTION

Such a hair removal apparatus is known, for example, from WO 2005/102623 A2 because this document discloses an essentially known wet shaver, on which an electrically drivable trimmer is also mounted. This trimmer is displaceably or pivotably mounted on the handle of the wet shaver. The trimmer may be moved approximately between a storage position and a use position, such that the trimmer in the use position comes to lie above the wet shaver, so that the wet shaver is not within the field of vision of the user when in use.

SUMMARY OF THE INVENTION

The object of the invention is therefore to improve upon a hair removal apparatus of the aforementioned type to improve the usability of the combined device comprising the wet shaver and the trimmer.

This object is achieved according to the invention by the characterizing features of claim 1.

The inventive approach allows the joint use of a trimmer and a wet shaver unit (which has at least one sharp-edged razor blade) arranged on a movable carrying element, thus permitting hygienic and aesthetic removal of hair in a single operation. The trimmer has at least two cutting parts drivable relative to one another, each having rows of teeth, cutting (i.e., shearing) the long hair at first just shortly above the skin, and then the wet shaver unit thoroughly removes the short cut hair down to the skin. The trimmer is suitable in particular for trimming wet hair or hair covered with shaving lotion or shaving foam and is designed to be washable in particular. The wet shaver unit has at least one sharp-edged razor blade and is suitable in particular for shaving wet hair or hair covered with shaving foam or shaving lotion. The wet shaver unit may be moved by means of the carrying element into a storage position in which the sharp-edged razor blade is arranged, so it is protected from unintentional contact with the skin in particular, which facilitates use of the device in comparison with devices such as those known from WO 2005/102623, where the wet shaver unit does not have such a storage position but instead is always exposed to the extent that it could come in contact with the user's skin and could then cause a painful cut of the user's skin. The protected position is characterized in particular by the fact that the at least one razor blade of the wet shaver unit is concealed by the housing of the hair removal apparatus when in the storage position and/or in the case of tangents applied to the housing of the hair removal apparatus and the outer contour of the wet shaver unit, the sharp-edged razor blade is situated inside the envelope formed by the tangents to the hair removal apparatus, so that contact of the sharp-edged razor blade can be achieved only by intentionally reaching into the interspace between the housing of the hair removal apparatus and the wet shaver unit. The wet shaver unit also has a use position, such that the wet shaver unit is arranged behind the trimmer when in the use position. Since a goal of body grooming devices is to achieve an aesthetic and complete removal of hair, such a use position of the wet shaver unit facilitates and improves the use of the device because the desired complete removal of hair can be achieved in one stroke by using this device. In the use position, the wet shaver unit is arranged so that the front edge of the sharp-edged razor blade lies in a plane with the front edge of the trimmer comb of the trimmer or comes to lie there during use (in particular in the case of a pivotably mounted wet shaver unit, the razor blade is optionally optimal only when a certain pivoting movement has been executed by means of pressure on the skin) and/or in a plane with the front edge of the safety attachment of the trimmer comb—if the trimmer has a safety attachment such that the trimmer teeth themselves do not come in contact with the user's skin.

The carrying element on which the wet shaver unit is arranged is displaceably guided on the housing, for example, whereby the displacement may be in a straight line and/or along a curve. This allows simple positioning by the user, whereby the positioning in different operating positions can be further simplified through corresponding catch elements arranged along the displacement path (the storage position and the use position are operating positions; additional operating positions are also possible, e.g., an operating position in which the wet shaver unit protrudes above the trimmer (the trimmer unit is then situated in an exposed position) so that a plain wet shave without a trimmer running ahead is made possible). Alternatively or additionally, a pivotable bearing of the carrying element on the housing is also possible, thus creating additional design options for the positioning of the wet shaver unit. The wet shaver unit could be brought out of the storage position into the use position by a pivoting movement.

According to an especially simple embodiment of the invention, the trimmer is arranged in a stationary position on the housing. However, to increase shaving comfort and/or with respect to a better adaptation of the trimmer to the contour of the skin surface to be shaved, it is advantageous if the trimmer is floatingly mounted on the housing. Such an embodiment allows the trimmer to yield as a function of the contact pressure applied by the user against an elastic pretension of the trimmer.

To allow simultaneous use of the trimmer and the wet shaver unit (in the use position), the tips of the teeth in the rows of teeth of the trimmer are aligned essentially in the same direction as the cutting edge of the razor blade. The trimmer is then arranged in such a way that it is situated in front of the cutting edge of the razor blade, as seen in the direction of the razor stroke (in the direction of use), so that a rough shave and/or pretrimming of hair is accomplished by means of the trimmer, while the razor blade completely shaves off the remaining hair.

For optimal adaptation of the wet shaver unit to the contour of the skin to be shaved, in another advantageous embodiment of the invention, it is also provided that the wet shaver unit is pivotably and/or floatingly mounted on the carrying element. For example, if the trimmer is floatingly mounted, the wet shaver unit can follow the yielding movement of the trimmer due to its own floating mount and can thus always come to lie in an optimum use position.

According to an embodiment of the invention that is optimized for achieving a thorough shave in particular, the wet shaver unit has multiple razor blades arranged on a joint carrier in particular. This essentially known multiblade arrangement produces a more thorough shave with the same number of razor strokes. With simultaneous use of trimmer and wet shaver unit (a shave in one stroke), the front edges of all razor blades are then situated in a plane with the front edge of the trimmer comb and/or with the front edge of a safety attachment of the trimmer comb and/or the front edges of the razor blades come to lie with the front edge of the trimmer in one plane during use—e.g., due to a pivotable and/or floating mount.

In conjunction with a spacer comb provided for the trimmer and known essentially from WO 00/37225 A1 for example, the inventive hair removal apparatus may be used not only for shaving but also for trimming hair to a preselected length. One embodiment of the invention is therefore provided with a fastening option for such a spacer comb. A certain distance between the trimmer and the skin to be shaved is set by means of the spacer comb. This distance then determines the length of the hair remaining. The spacer comb may be designed to be adjustable in an essentially known manner, so the user can adjust different distances with a single spacer comb and can thus adjust different remaining hair lengths. However, it is also possible to adjust the remaining hair length by selecting a spacer comb of the desired length from a set of spacer combs of different lengths and then attach it to the housing of the hair removal apparatus.

In one embodiment of the hair removal apparatus, the wet shaver unit is covered completely by the spacer comb, thus preventing unwanted hair trimming and in particular a risk of injury due to the wet shaver unit are prevented (the wet shaver unit could be shifted unintentionally out of the storage position, but this is prevented by the spacer comb). Even if the razor blade of the wet shaver unit is arranged in a position where it is protected from unintentional contact with skin when in the storage position, the razor blade can nevertheless come in contact with hair. This is also prevented by the embodiment of the spacer comb proposed here.

BRIEF DESCRIPTION OF THE DRAWINGS

Additional goals, features and possible applications of the present invention are derived from the following description of an exemplary embodiment. All the features described or illustrated in the figures, either alone or in any combination, form the subject of the present invention, even independently of how they are combined in the claims or their reference back to previous claims.

DETAILED DESCRIPTION OF THE INVENTION

Figure 1:
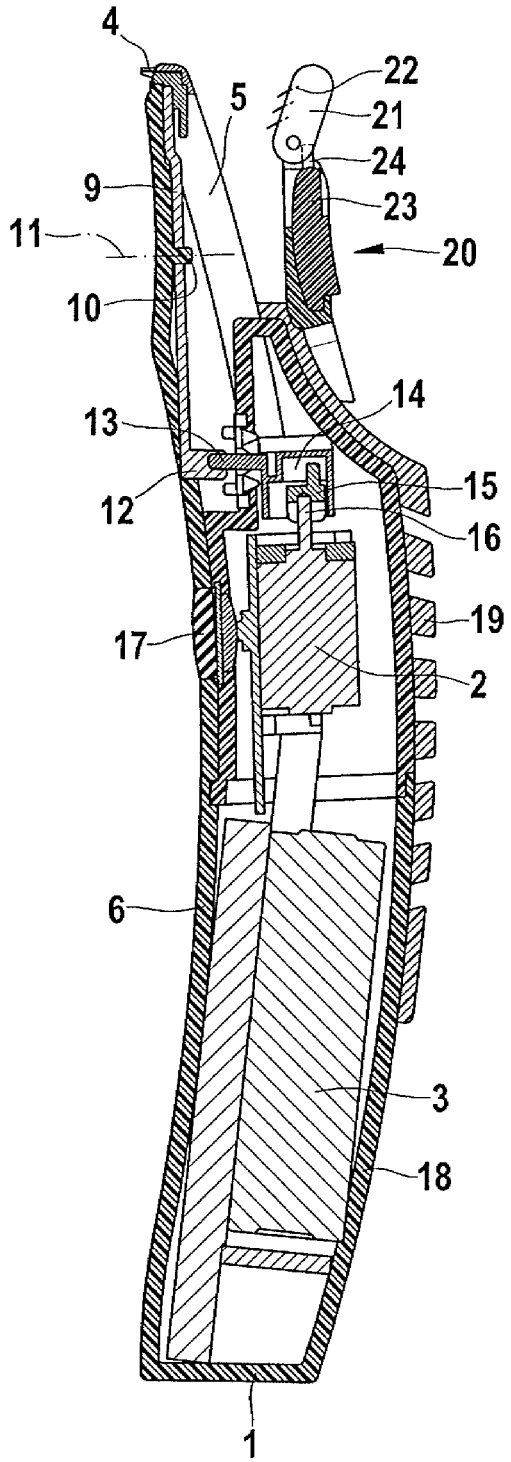
FIGS. 1 and 2 each show a section through an inventive hair removal apparatus, where the carrying element of the wet shaver unit is in the retracted position, so the wet shaver unit is in the storage position.
Figure 7:
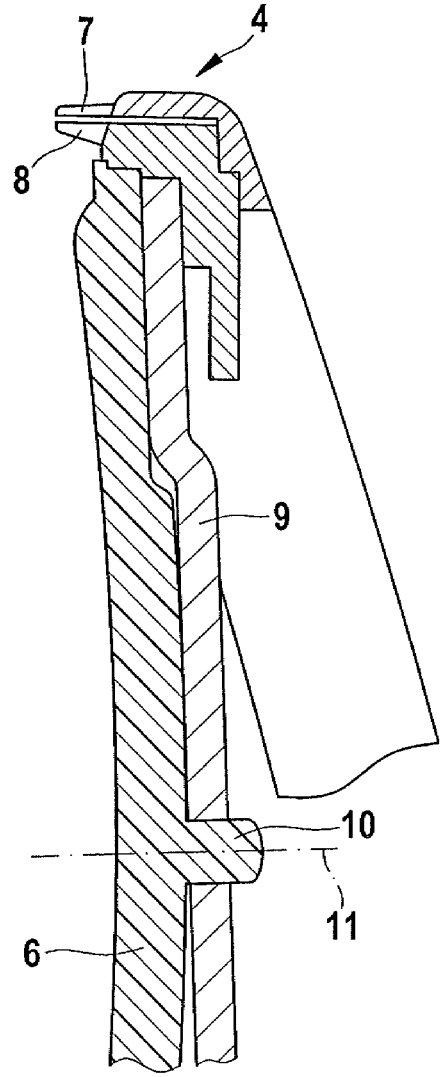
FIG. 7 shows the trimmer according to FIG. 1 in an enlarged diagram.

The hair removal apparatus shown in a side view of a section in FIG. 1 has a housing 1, which holds an electric motor 2 and an electric energy storage mechanism embodied as an electric battery 3. A trimmer 4 is arranged on the upper end section 5 of the housing 1, having an elongated design, its cutting elements pointing in the direction of the front side 6 of the housing. FIG. 7 shows the trimmer with an essentially known design on an enlarged scale. The trimmer 4 comprises a stationary trimmer comb 7 and a driven trimmer blade 8, with the trimmer blade 8 arranged beneath the trimmer comb. Both the trimmer comb 7 and the trimmer blade 8 are designed in the shape of a comb having a plurality of prongs arranged one after the other in rows, with the prongs being aligned toward the left according to the figure, i.e., in the direction of the front side 6 of the housing. Whereas the trimmer comb 7 is fixedly mounted on the housing, the trimmer blade 8 running parallel to it is attached to the end of a rocker arm 9 mounted to pivot about a rotary bearing 10 that defines a rotational axis 11 on the inside of the housing front part 6. On the end of the rocker arm 9 opposite the trimmer blade 8, a tappet 12 is formed, engaging with the drive pin 13 formed on a swing bridge 14 (see FIG. 1). The cam 15 arranged on the drive shaft 16 of the electric motor 2 that can be driven to rotate engages in this swing bridge 14. From the rotational movement of the drive shaft 16, the swing bridge 14 produces a linear oscillating movement at a right angle to the plane of the drawing. An on/off switch 17 provided in the front part 6 of the housing serves to connect the electric motor 2 to the electric power supply of the battery 3 and disconnect it therefrom, respectively. When the electric motor 2 is turned on, the rotary drive shaft 16 in combination with the cam 15 generates the oscillating movement of the swing bridge 14, which is transmitted via the drive pin 13 to the tappet 12 on the rocker arm 9. This in turn leads to an oscillating pivoting movement of the rocker arm 9 about the rotational axis 11 and thus leads to an oscillating displacement of the trimmer blade 8 relative to the trimmer comb 7, so that hair passing between the prongs of this cutting system is cut off.

A carrying element designed as a carrying element 19 is arranged vertically displaceably on the back side 18 of the housing. Therefore, guides (not shown in the drawing) are arranged on these parts. FIG. 1 shows the carrying element 19 in its lower end position. A receptacle 20 for a wet shaver unit 21 is arranged on the upper end of the carrying element 19. The receptacle 20 allows the attachment and release of the wet shaver unit 21, on which several sharp-edged razor blades 22 are arranged. The receptacle 20 has a release button 23 with a tappet 24 directed upward. To release the wet shaver unit 21 that has engaged in the receptacle 20, the release button 23 is moved upward, so that the tappet 24 acts upon the wet shaver unit 21 and pushes it out of the receptacle 20. As an alternative to the embodiment shown here, instead of the implementation of the wet shaver unit 21 as a blade carrier (also known as a blade cartridge) as shown here, a single sharp-edged razor blade 22 may also be provided as the wet shaver unit 21 on the carrying element 19. In the lower operating position here, the wet shaver unit 21 on the carrying element 19 is thus in a storage position, where the sharp-edged razor blade 22 is concealed before contact with the skin, so that the device cannot cause injury to the skin if used carelessly (tilting of the hair removal apparatus toward the skin). The storage position need not be a position in which skin contact with the razor blade cannot be forced at all (e.g., due to intentional insertion of a finger into the space between the wet shaver unit and the rear wall of the trimmer housing 1) but instead is in a position in which skin contact typically does not occur in the usual use of the hair removal apparatus. In particular the sharp-edged razor blade 22 is within an envelope enclosing the hair removal apparatus, formed by tangents to the housing 1 and the outer contour of the wet shaver unit 21. Then the skin cannot come in contact with the sharp-edged razor blade due to tilting of the hair removal apparatus toward a skin surface that is planar with respect to the distance between the housing 1 and the wet shaver unit 21.

The operating position of the carrying element 19 and/or the razor blades 22 shown in FIG. 1 represents a storage position for the wet shaver unit in which the razor blades 22 are protected behind the upper end section 5 of the housing 1. In this storage position, only the trimmer 4 may be used for trimming or removing hair.

Figure 2:
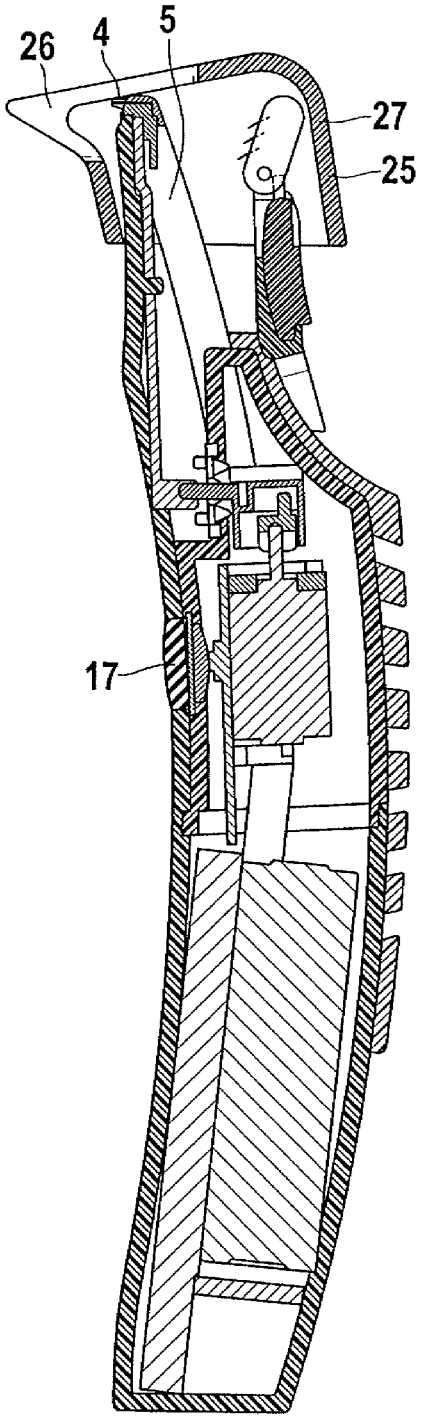

FIG. 2 shows the inventive hair removal apparatus with razor blades in the storage position, i.e., as already shown in FIG. 1, but with a spacer comb 25 placed on the upper end section 5. The spacer comb defines a minimum distance between the trimmer 4 and the hair to be shaved in a known way, resulting in the hair being trimmed only to a certain extent when the trimmer 4 is used with the spacer comb 25 attached, but a completely smooth shave is no longer possible. Hair to be trimmed is passed to the trimmer 4 through slots 26 which run parallel to the extent of the prongs of the trimmer comb 7 and/or the trimmer blade 8 and are arranged in the forward part of the spacer comb 25. The rear part 27 of the spacer comb 25 can cover the razor blades 22 and the wet shaver unit 21, so that they cannot come in contact with the hair on the skin surface to be treated.

Figure 3:
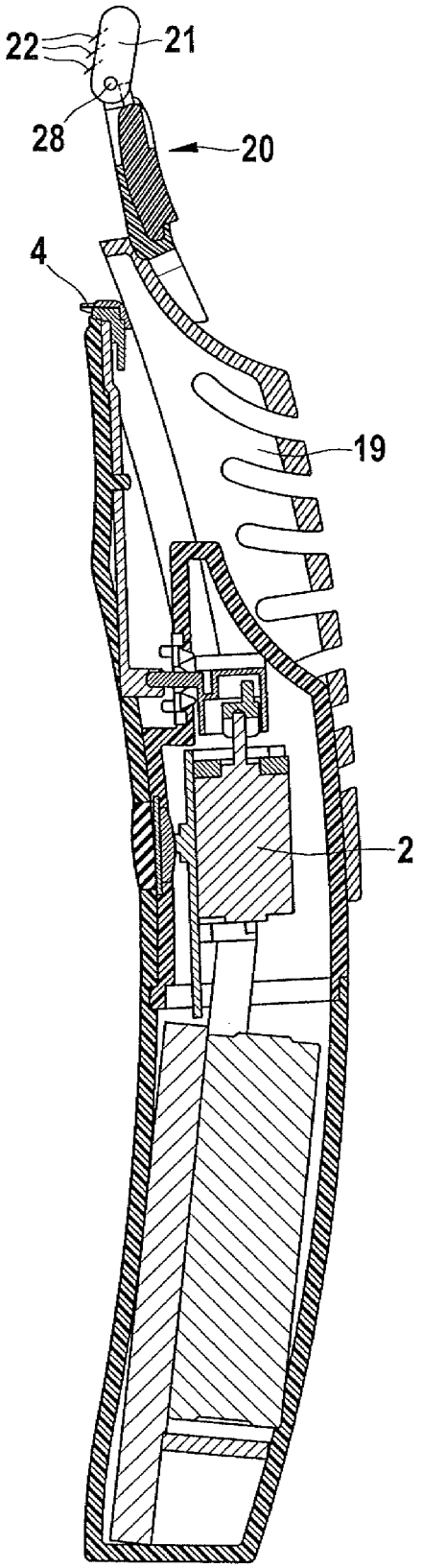
FIG. 3 shows such a section in which the carrying unit is in a maximally extracted position, allowing use of the wet shaver unit alone.

FIG. 3 shows the hair removal apparatus in an operating state in which the carrying element 19 is in its maximally extracted position, i.e., extracted completely toward the front. This position of the carrying element 19 is set by the user when he wants to use only the wet shaver unit, i.e., the razor blades 22 for a (wet) shave. In this highly extracted position, the wet shaver unit is so far away from the trimmer 4 that no more risk can emanate from it with respect to inadvertent scratching of the skin while using the razor blades 22. Through appropriate electrical or mechanical means (which are not shown in the drawing here), it is possible to ensure that in the maximally extracted position of the carrying element 19, it is no longer possible to turn on the electric motor 2. For the best possible adaptation of the razor blades 22 to the contour of the skin to be shaved, the wet shaver unit 21 is mounted to pivot about a pivot axis 28 on the carrying element 19 and/or on the receptacle 20.

Figure 4:
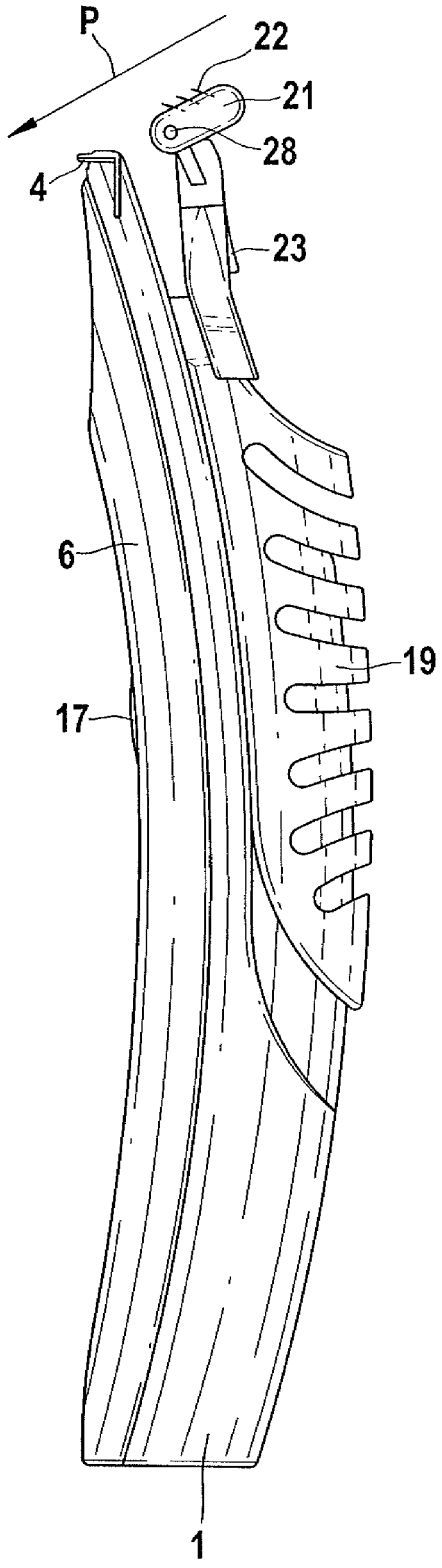
FIGS. 4 to 6 show side views from the rear and in perspective diagrams of an inventive hair removal apparatus in which the carrying element with the wet shaver unit is in a middle operating position in which hair can be removed simultaneously by the trimmer, which is leading in the direction of use, and the trailing wet shaver unit in the direction of use.
Figure 5:
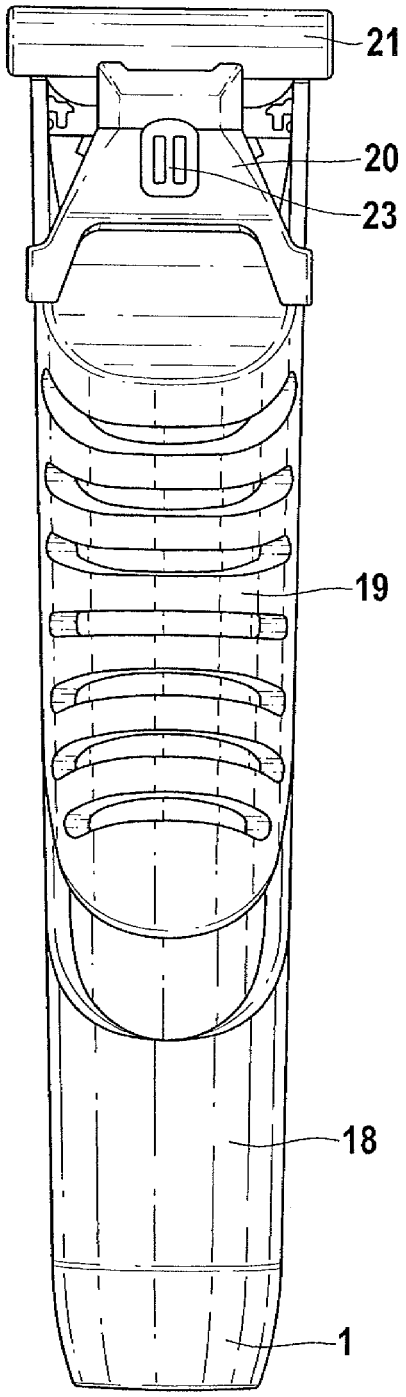
Figure 6:
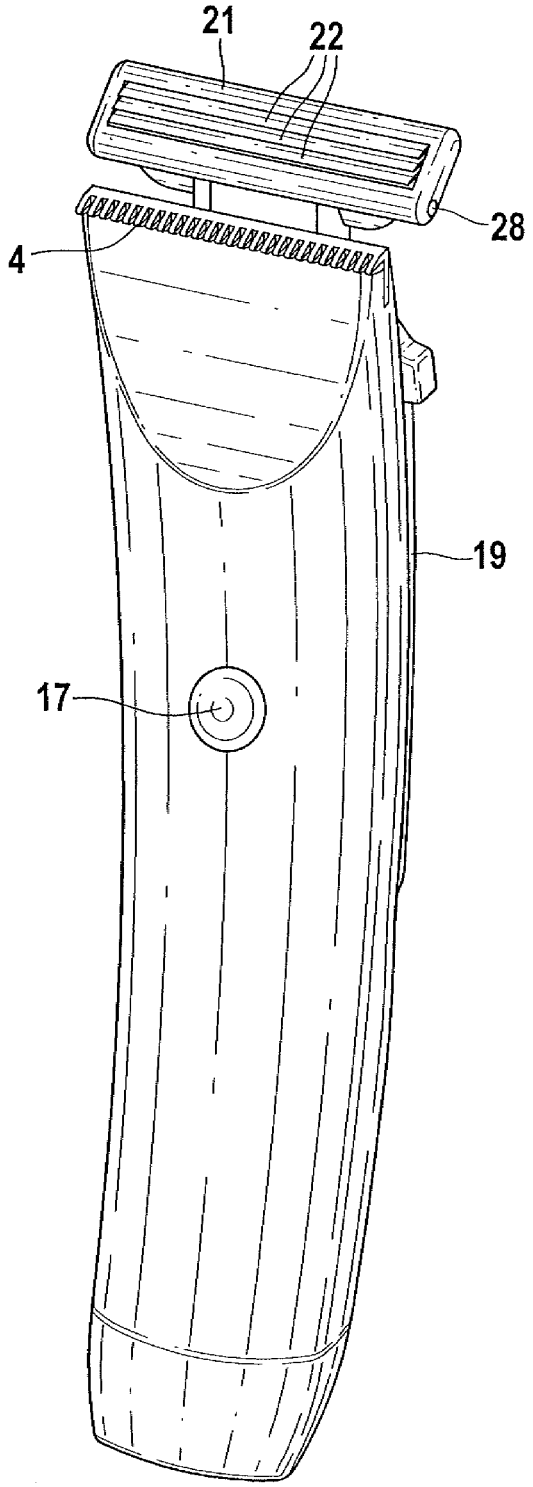

FIGS. 4 to 6 show the inventive hair removal apparatus with the carrying element 19 in a use position, which allows the simultaneous use of both the trimmer 4 and the wet shaver unit 21 for a so-called "combination shave." When the carrying element 19 is in the use position, as illustrated in FIG. 4, if the hair removal apparatus is pulled in the use direction, i.e., according to the arrow P, over the skin surface that is to be shaved, then the hair present there is first trimmed by the trimmer 4 which runs ahead in the use direction (depending on the trimmer geometry, typically hair with a length of less one millimeter remains on the skin) and any hair still remaining is then thoroughly shaved off by the wet shaver unit during a stroke of same. Devices such as those known from WO 2005/102623 A2 do not offer the possibility of protecting the at least one sharp-edged razor blade of the wet shaver unit from unintentional contact with skin in the storage position nor does it offer the possibility of a shave in one stroke. A shave in one stroke is also not provided in WO 2005/102623 A2 but instead only one individual use of either the wet shaver or the trimmer is provided. However, the specific arrangement proposed here offers the possibility of shaving in one stroke because the trimmer runs ahead of the wet shaver unit in the use direction and thus the trimmer first can cut even long hair until it is just above the skin before the wet shaver unit then assumes the task of thoroughly shaving off the remaining short hair in a manner familiar to the user from wet shaving. Due to the fact that the trimmer first trims the hair in a previous hair removal operation, the wet shaver unit need handle only the usual task, namely that of shaving off short hair, resulting in an aesthetically clean shaving result. It is not necessary here to pass twice over the area of skin to be shaved, as is done with the known combinations of wet shavers and trimmers, in order to first trim the long hair with the trimmer and then shave off the trimmed hair with the wet shaver unit. The proposed arrangement is especially appropriate for body shaving.

What is claimed is:

1. A hair removal apparatus having a trimmer (4), whereby the trimmer (4) has at least two cutting parts (7, 8) that each have rows of teeth, wherein the rows of teeth of one of the cutting parts is drivable relative to the other cutting part, and having at least one wet shaver unit (21) which has at least one sharp-edged razor blade (22), characterized in that the at least one wet shaver unit (21) is arranged on a carrying element (19) guided movably on a housing (1), said carrying element being adjustable by a user in at least two different positions, a first position being a storage position of the wet shaver unit and a second position allowing simultaneous removal of hair by the trimmer (4) which is leading in a direction of use (P) and the at least one wet shaver unit (21).

2. The device according to claim 1, wherein the at least one sharp-edged razor blade (22) is arranged so that it is protected from unintentional contact with skin when in the storage position.

3. The device according to claim 1, characterized in that the rows of teeth have tips which are facing essentially the same direction as the edge of the at least one razor blade (22).

4. The device according to claim 1, characterized in that the at least one sharp-edged razor blade (22) comprises at least two sharp-edged razor blades (22).

5. The device according to claim 1, characterized in that the at least one wet shaver unit (21) can be covered by a spacer comb (25).

* * * * *